United States Patent [19]

Ohsaki et al.

[11] Patent Number: 4,743,425

[45] Date of Patent: May 10, 1988

[54] METHOD OF PRODUCING FERROUS SINTERED ALLOYS WITH SUPERIOR ABRASION RESISTANCE

[75] Inventors: Shigemi Ohsaki; Sumio Kamino, both of Hiroshima; Minoru Nitta, Chiba, all of Japan

[73] Assignees: Mazda Motor Corporation; Kawasaki Steel Corp., both of Japan

[21] Appl. No.: 92,530

[22] Filed: Sep. 3, 1987

[30] Foreign Application Priority Data

Sep. 8, 1986 [JP] Japan ..... 61-211177

[51] Int. Cl.[4] ..... B22F 1/00

[52] U.S. Cl. ..... 419/16; 419/23; 419/26; 419/29; 419/38; 419/44; 419/47; 419/54; 419/57; 419/58; 419/60; 75/242; 75/238; 75/246

[58] Field of Search ..... 75/230, 238, 240, 242, 75/246; 419/11, 12, 14–16, 23, 26, 29, 38, 44, 47, 54, 57, 58, 60

[56] References Cited

U.S. PATENT DOCUMENTS

| | | | |
|---|---|---|---|
| 3,983,615 | 10/1976 | Morishita | 75/246 |
| 4,000,980 | 1/1977 | Morishita et al. | 75/244 |
| 4,344,795 | 8/1982 | Endo et al. | 75/243 |
| 4,556,533 | 12/1985 | Oaku et al. | 419/11 |
| 4,561,889 | 12/1985 | Oaku et al. | 75/243 |
| 4,563,329 | 1/1986 | Morishita et al. | 75/240 |
| 4,594,104 | 6/1986 | Reybould | 75/243 |
| 4,696,696 | 9/1987 | Fujita et al. | 75/241 |
| 4,702,771 | 10/1987 | Takagi et al. | 75/241 |

*Primary Examiner*—Stephen J. Lechert, Jr.
*Attorney, Agent, or Firm*—Gerald J. Ferguson, Jr.; Michael P. Hoffman; Michael J. Foycik, Jr.

[57] ABSTRACT

A method of producing ferrous sintered alloys comprises the steps of preparing mixed alloy powder containing Fe-P-C eutectic alloy powder which includes phosphorus within the range of 2.0% to 3.0% by weight, carbon not more than 4.0% by weight and one of molybdenum within the range of 8.0% to 11.0% by weight and boron within the range of 0.5% to 3.0% by weight, graphite, and ferroalloy powder containing chromium within the range of 11% to 14% by weight; causing the mixed alloy powder to be subjected to compression molding to have a green compact; and sintering the green compact to have a ferrous sintered alloy containing compound carbides in a matrix structure thereof. The graphite is so selected that the sum total of the graphite and the carbon included in the Fe-P-C eutectic alloy powder constitutes a part within the range of 5% to 8% by weight of the sum total of the graphite and the Fe-P-C eutectic alloy powder. Further, the ferroalloy powder is so selected as to constitute a part within the range of 30% to 70% by weight of the whole mixed alloy powder.

12 Claims, 2 Drawing Sheets

$T_1$ $T_2$ $T_5$ $T_6$

METHOD OF PRODUCING FERROUS SINTERED ALLOYS WITH SUPERIOR ABRASION RESISTANCE

BACKGROUND OF THE INVENTION

1. Field of the Invention

The present invention relates to a method of producing ferrous sintered alloys with superior abrasion resistance which are used for forming components of a valve operating mechanism in a engine or the like.

2. Description of the Prior Art

There has been proposed to make movable components of an engine which are required to have sufficient abrasion resistance, such as rocker arms, of ferrous sintered alloy which is obtained by sintering a green compact formed through compression molding of ferro-alloy powder. One of ferrous sintered alloys proposed previously for use of making the movable components of the engine thereof is disclosed in, for example, the Japanese patent application published before examination under publication No. 59/83704. The ferrous sintered alloy thus proposed previously is obtained by sintering a green compact of ferrous eutectic alloy powder which contains carbon, boron, molybdenum, phosphorus and other similar elements, and includes in its matrix structure boron carbide, molybdenum carbide, phosphorus carbide and other simple carbides, together with compound carbides, so as to have improved abrasion resistance inherent therein.

The ferrous eutectic alloy powder which contains carbon and phosphorus and is used as raw material of the ferrous sintered alloy is produced generally through processes of melting metals of several kinds including iron and mixed with one another at a mutual weight ratio predetermined in accordance with an expected characteristic of the ferrous sintered alloy, solidifying the melted metals to obtain an alloy ingot, and grinding the alloy ingot with use of, for example, a suitable stamp mill into powder. In such processes for producing the ferrous eutectic alloy powder, it is usual that the alloy ingot has portions unhomogeneous in internal structure of solidified metals, in other words, the alloy ingot is attended with segregation resulting from a difference in solute concentration between a solid phase portion and a liquid phase portion both appearing to form a boundary therebetween at an initial step of melting of the metals.

When the green compact which is formed through compression molding of the ferrous eutectic alloy powder thus produced by grinding the alloy ingot attended with segregation into powder is sintered, low melting point portions of the ferrous eutectic alloy powder forming the compact and having internal structures affected with the segregation melt antecedently to other portions to become liquid phase components and the crystal grain boundary of the alloy is filled with the liquid phase components having arisen thus. Accordingly, the crystal grains of the alloy are drawn to one another with the surface tension of the liquid phase components and thereby coupled with one another under the condition in which pores and other undesirable spaces are restrained from arising. Consequently, the ferrous sintered alloy with improved abrasion resistance is obtained.

However, in the case where such a method including processes of melting the metals including iron and mixed with one another, solidifying the melted metals to obtain the alloy ingot, and grinding the alloy ingot into powder as described above is adopted to produce the ferrous eutectic alloy powder used as raw material of the ferrous sintered alloy, there is a disadvantage that the production cost of the ferrous eutectic alloy powder is increased.

Meanwhile, there has been also proposed an atomization method through which a ferrous eutectic alloy powder containing carbon and phosphorus is obtained directly from melted metals of several kinds including iron as a method of producing the ferrous eutectic alloy powder by which the production cost of the ferrous eutectic alloy powder can be effectively reduced. According to the atomization method, the melted metals of several kinds including iron is poured from nozzle and then splashed by a compressed gas or a jet of water jet blown thereto so as to be quenched to solidify, and as a result, the ferrous eutectic alloy powder used as raw material of the ferrous sintered alloy is obtained at reduced production cost.

However, when the atomization method is used for producing the ferrous eutectic alloy powder containing carbon and phosphorus directly from the melted metals of several kinds including iron, the ferrous eutectic alloy powder obtained as a result of splashing and quenching the melted metals is little attended with segregation and is in a stable condition to be homogeneous in its internal structure. Accordingly, when the green compact which is formed through compression molding of the ferrous eutectic alloy powder produced through the atomization method is sintered, liquid phase components which arises as a sequel to melting of low melting point portions of the ferrous eutectic alloy powder forming the green compact are not obtained sufficiently, and therefore the ferrous sintered alloy obtained by sintering the green compact formed by the ferrous eutectic alloy powder produced through the atomization method is provided therein with a large number of pores undesirably so as to have relatively low hardness.

In order to make an improvement in the ferrous sintered alloy obtained from the ferrous eutectic alloy powder produced through the atomization method, it is considered to sinter the green compact formed through compression molding of the ferrous eutectic alloy powder produced through the atomization method at increased sintering temperature so as to increase the liquid phase components arising in the green compact. In such a case, however, there is another problem that several kinds of phosphides each of which is generally hard but brittle are crystallized around each of carbides arising in a matrix structure of the ferrous sintered alloy. Then, when the ferrous sintered alloy in which the phosphides are crystallized is used for making thereof a movable part of an engine having a sliding friction surface, another part of the engine which is in contact with the sliding friction surface of the movable part is caused to have undesirably increased abrasion loss at portions hereof coming into contact with the sliding friction surface of the movable part.

OBJECTS AND SUMMARY OF THE INVENTION

Accordingly, it is an object of the present invention to provide a method of producing a ferrous sintered alloys which avoids the aforementioned disadvantage and problem encountered with the prior art.

Another object of the present invention is to provide a method of producing ferrous sintered alloys, through which a ferrous sintered alloy, which has superior abrasion resistance and of which a movable part of an engine having a sliding friction surface prevented from causing another part of the engine which is in contact therewith to have undesirably increased abrasion loss can be made, is obtained by sintering a green compact formed with ferrous eutectic alloy powder containing carbon and phosphorus and obtained in sequel to splashing and quenching melted metals including iron through the atomization method or the like.

A further object of the present invention is to provide a method of producing ferrous sintered alloys, through which a ferrous sintered alloy with superior abrasion resistance is obtained by sintering a green compact which is formed with ferrous eutectic alloy powder containing carbon and phosphorus and obtained in sequel to splashing and quenching melted metals including iron through the atomization method or the like, in such a manner that appropriate liquid phase components arise in the green compact during the sintering of the green compact and phosphides are restrained from being crystallized in the ferrous sintered alloy.

According to the present invention, there is provided a method of producing ferrous sintered alloys which comprises the steps of preparing mixed alloy powder containing Fe-P-C eutectic alloy powder which is obtained in sequel to quenching a melted metal mixture to solidify the same and includes phosphorus within the range of 2.0% to 3.0% by weight, carbon not more than 4.0% by weight, and one of molybdenum within the range of 8.0% to 11.0% by weight and boron within the range of 0.5% to 3.0% by weight, graphite so selected that the sum total of the graphite and the carbon included in the Fe-P-C eutectic alloy powder constitutes a part within the range of 5% to 8% by weight of the sum total of the graphite and the Fe-P-C eutectic alloy powder, and ferroalloy powder containing chromium within the range of 11% to 14% by weight and so selected as to constitute a part within the range of 30% to 70% by weight of the whole mixed alloy powder; causing the mixed alloy powder to be subjected to compression molding to have a green compact of a predetermined shape; and sintering the green compact to have a ferrous sintered alloy containing compound carbides in a matrix structure thereof. The Fe-P-C eutectic alloy powder includes preferably chromium within the range of 2.5% to 5.0% by weight as an element other than iron, phosphorus and carbon, in addition to one of molybdenum within the range of 8.0% to 11.0% by weight and boron within the range of 0.5% to 3.0% by weight, which acts as one of eutectic components together with the iron, phosphorus and carbon.

In accordance with the method of the present invention, the mixed alloy powder which is obtained by mixing the graphite and the ferroalloy powder with the Fe-P-C eutectic alloy powder obtained by means of quenching the melted metal mixture to solidify, is prepared. In such a process, the Fe-P-C eutectic alloy powder is arranged to include the phosphorus within the range of 2.0% to 3.0% by weight, carbon not more than 4.0% by weight, and one of the molybdenum within the range of 8.0% to 11.0% by weight and the boron within the range of 0.5% to 3.0% by weight, the graphite is added so that the sum total of the graphite and the carbon included in the Fe-P-C eutectic alloy powder constitutes a part within the range of 5% to 8% by weight of the sum total of the graphite and the Fe-P-C eutectic alloy powder, and the ferroalloy powder is arranged to contain the chromium within the range of 11% to 14% by weight and constitute the part within the range of 30% to 70% by weight of the whole mixed alloy powder. Then, the green compact which is formed through the compression molding of the mixed alloy powder is sintered. In the process of sintering, appropriate liquid phase components arise in the green compact with an action of each of the graphite and the ferroalloy powder containing the chromium within the range of 11% to 14% by weight which are mixed with the Fe-P-C eutectic alloy powder, and therefore the ferrous sintered alloy which is a product of the sintering is provided desirably with the compound carbides in its matrix structure.

Consequently, the ferrous sintered alloy thus obtained according to the present invention has superior abrasion resistance. Further, the ferrous sintered alloy obtained through the method according to the present invention is produced from the Fe-P-C eutectic alloy powder which is obtained in sequel to quenching the melted metal mixture to solidify. This means that the Fe-P-C eutectic alloy powder obtained through the atomization method or the like at relatively low cost can be used as law material of the ferrous sintered alloy in the method according to the present invention, and therefore the production cost of the ferrous sintered alloy produced through the method according to the present invention is effectively reduced.

In addition, in the case where a movable part of an engine having a sliding friction surface, such as a rocker arm, is made of the ferrous sintered alloy produced through the method according to the present invention, another part of the engine which is in contact with the movable part can be prevented from having undesirably increased abrasion loss at its portion coming into contact with the sliding friction surface of the movable part.

The above and other objects, features and advantages of the present invention will become apparent from the following detailed description which is to be read in conjunction with the accompanying drawings.

DESCRIPTION OF THE PREFERRED EMBODIMENT

Figure 1:
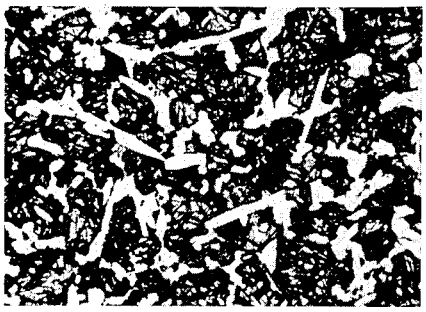
FIGS. 1 and 2 are microphotographs each showing an internal structure of an example of a ferrous sintered alloy obtained through one embodiment of method of producing ferrous sintered alloys according to the present invention.

Now, a series of processes for obtaining several ferrous sintered alloys in accordance with an embodiment of method of producing ferrous sintered alloys according to the present invention will be described in detail.

In this embodiment, Fe-Mo-Cr-P-C eutectic alloy powder is selected to be used as Fe-P-C eutectic alloy powder. First, Fe-Mo-Cr-P-C eutectic alloy powder which is obtained by quenching a melted metal mixture splashed in accordance with the atomization method to solidify with the particle size not more than 150 mesh and includes carbon (C) not more than 4.0% by weight, chromium (Cr) within the range of 2.5% to 5.0% by weight, molybdenum (Mo) within the range of 8.0% to 11.0% by weight, phosphorus (P) within the range of 2.0% to 3.0% by weight, and iron of the remainder, is prepared. By way of example, four samples of the Fe-Mo-Cr-P-C eutectic alloy powder $X_1$, $X_2$, $X_3$ and $X_4$ having respective compositions as shown in Table 1 mentioned below are provided.

TABLE 1

| Sample of Eutectic Alloy Powder | Components (% by weight) | | | | |
|---|---|---|---|---|---|
| | C | P | Cr | Mo | Fe |
| $X_1$ | 3.69 | 2.21 | 4.78 | 8.64 | remainder |
| $X_2$ | 0.068 | 2.29 | 4.59 | 10.2 | remainder |
| $X_3$ | 1.92 | 2.03 | 4.74 | 10.2 | remainder |
| $X_4$ | 3.92 | 2.05 | 2.9 | 8.0 | remainder |

Next, graphite powder with the particle diameter of 10μ or less is added to the Fe-Mo-Cr-P-C eutectic alloy powder prepared as mentioned above to produce eutectic alloy powder containing graphite. The graphite added to the Fe-Mo-Cr-P-C eutectic alloy powder is so selected that the sum total of the graphite and the carbon included in the Fe-Mo-Cr-P-C eutectic alloy powder constitutes a part within the range of 5% to 8% by weight of the sum total of the graphite and the Fe-Mo-Cr-P-C eutectic alloy powder.

Table 2 mentioned below shows four samples of eutectic alloy powder containing graphite $Y_1$, $Y_2$, $Y_3$ and $Y_4$ which were obtained by adding graphite of 1.38% by weight to sample $X_1$, graphite of 7.3% by weight to sample $X_2$, graphite of 4.9% by weight to sample $X_3$, and graphite of 2.2% by weight to sample $X_4$, respectively.

TABLE 2

| Sample of Eutectic Alloy Powder containing Graphite | Added Graphite (% by weight) | Sum Total of Carbon and Graphite (% by weight) |
|---|---|---|
| $Y_1$ | 1.38 | 5.0 |
| $Y_2$ | 7.3 | 8.0 |
| $Y_3$ | 4.9 | 6.5 |
| $Y_4$ | 2.2 | 6.0 |

Then, Fe-Cr alloy powder consisting of chromium of 12% by weight and iron of the remainder with the particle size not more than 150 mesh is added to the eutectic alloy powder containing graphite so as to constitute a part within the range of 30% to 70% by weight of the sum total of the eutectic alloy powder containing graphite and the Fe-Cr alloy powder and to produce mixed alloy powder. Further, paraffin of 1.5% by weight or zinc stearate of 2.0% weight is added as a binder to the mixed alloy powder and the mixed alloy powder added the binder thereto is subjected to compression molding at pressure within the range of 5.5 ton/cm$^2$ to 6.0 ton/cm$^2$ so as to be formed into a green compact in a predetermined shape.

Table 3 mentioned below shows four samples of green compact $Z_1$, $Z_2$, $Z_3$ and $Z_4$ which are produced from four kinds of mixed alloy powder which were obtained by mixing the Fe-Cr alloy powder consisting of chromium of 12% by weight and iron on the remainder with the samples $Y_1$, $Y_2$, $Y_3$ and $Y_4$, respectively, so as to constitute 55% by weight of the sum total of the sample $Y_1$ and the Fe-Cr alloy powder, 60% by weight of the sum total of the sample $Y_2$ and the Fe-Cr alloy powder, 50% by weight of the sum total of the sample $Y_3$ and the Fe-Cr alloy powder,and 50% by weight of the sum total of the sample $Y_4$ and the Fe-Cr alloy powder.

TABLE 3

| Green Compact | Mixing Ratio (% by weight) | |
|---|---|---|
| | Eutectic Alloy Powder containing Graphite | Fe—Cr Alloy Powder |
| $Z_1$ | 45 | 55 |
| $Z_2$ | 40 | 60 |
| $Z_3$ | 50 | 50 |
| $Z_4$ | 50 | 50 |

The green compact is formed in the shape of chip through compression molding of the mixed alloy powder which obtained by mixing the graphite and the Fe-Cr alloy powder with the Fe-Mo-Cr-P-C eutectic alloy powder and is subjected to preheating in the ambient atmosphere of hydrogen gas ($H_2$) at about 600° C. to produce a pre-sintered body.

The pre-sintered body thus obtained is regularly sintered in a vacuum furnace at temperature within the range of 1060° C. to 1100° C. for 20 to 30 minutes and then subjected to heating at about 900° C. for about 30 minutes so that a sintered body is obtained. After that, the sintered body is subjected to quenching in the ambient atmosphere of nitrogen gas ($N_2$) and further tempering in a vacuum furnace at temperature within the range 550° C. to 560° C. for about 100 minutes. Through the processes described above, the ferrous sintered alloy is produced.

Four samples of ferrous sintered alloy $T_1$, $T_2$, $T_3$ and $T_4$ were produced respectively from the samples of green compact $Z_1$, $Z_2$, $Z_3$ and $Z_4$ each caused to be subjected to such sintering, quenching and tempering as mentioned above, and it was recognized that four samples $T_1$, $T_2$, $T_3$ and $T_4$ had harness of $H_{RC}=56$, $H_{RC}=55$, $H_{RC}=58$ and $H_{RC}=57$, respectively, and each of four samples $T_1$, $T_2$, $T_3$ and $T_4$ was provided with superior abrasion resistance.

Figure 2:
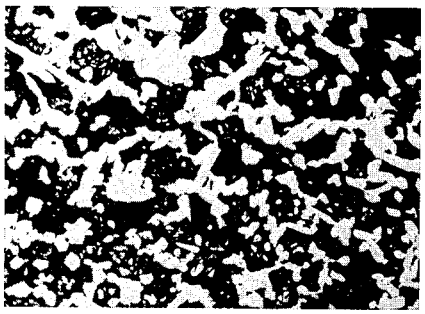

FIGS. 1 and 2 show microphotographs of internal structures of the samples $T_1$ and $T_2$ obtained from the samples of green compact $Z_1$ and $Z_2$, respectively. In these microphotographs shown in FIGS. 1 and 2, each of black portions represents a matrix structure of martensite and each of white portions distributed almost uniformly in the matrix structure represents chromium carbides or compound chromium- molybdenum carbides residing in the matrix structure.

Now, comparison between the samples of ferrous sintered alloy $T_1$, $T_2$, $T_3$ and $T_4$ produced through the embodiment of method of producing ferrous sintered alloys according to the present invention and three reference samples of ferrous sintered alloy $T_5$, $T_6$ and $T_7$ produced through a method other than the method according to the present invention will be described hereinafter.

Previous to explanation of the comparison, the processes by which the reference sample of ferrous sintered alloy $T_5$ was produced will be described. In production of the reference sample $T_5$, first, eutectic alloy powder which was obtained in accordance with the atomization method with the grain size not more than 150 meshes and includes carbon of 4.16% by weight, phosphorus of 3.18% by weight, chromium of 4.85% by weight, molybdenum of 10.1% by weight and iron of the remainder, was mixed with Fe-Cr alloy powder with the grain size not more than 150 mesh including chromium 12.5% by weight and iron of the remainder at the mixing ratio of 45/55 by weight to produce mixed alloy powder. Then, zinc stearate of 2% by weight was added as a binder to the mixed alloy powder and the mixed alloy powder added the binder thereto was subjected to compression molding at pressure of 5.5 ton/cm$^2$ so as to be formed into a green compact in the shape of chip.

Next, the green compact was subjected to preheating in the ambient atmosphere of hydrogen gas at 600° C. to produce a pre-sintered body. The pre-sintered body was regularly sintered in a vacuum furnace at 1100° C. for 20 minutes and then subjected to heating at 900° C. for about 30 minutes so that a sintered body is obtained. After that, the sintered body was subjected to quenching in the ambient atmosphere of nitrogen gas and further tempering in a vacuum furnace at 560° C. for 100 minutes, so that the reference sample $T_5$ was obtained.

Figure 3:
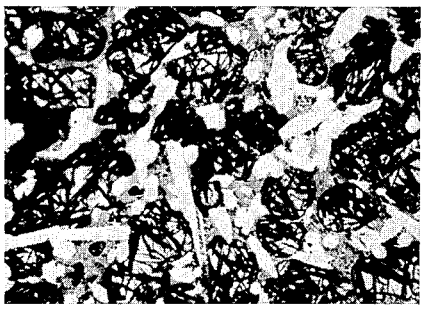
FIGS. 3 and 4 are microphotographs each showing an internal structure of a ferrous sintered alloy obtained through a method other than the method of producing ferrous sintered alloys according to the present invention.

FIG. 3 shows a microphotograph of the internal structure of the reference sample $T_5$. In the microphotograph shown in FIG. 3, chromium carbides or compound chromium-molybdenum carbides (white portions) appear in the matrix structure (black portion) and further phosphides (gray portions) also appear in the shape of a net around the chromium carbides or compound chromium-molybdenum carbides. It was recognized that the reference sample $T_5$ is provided with hardness of $H_{RC}=56$.

Subsequently, the processes by which the reference sample of ferrous sintered alloys $T_6$ was produced will be described.

In production of the reference sample $T_6$, first, eutectic alloy powder which was obtained in accordance with the atomization method with the particle size not more than 150 meshes and includes carbon of 3.1% by weight, phosphorus of 2.28% by weight, chromium of 5.5% by weight, molybdenum of 12% by weight and iron of the remainder, was prepared. Next, graphite powder was added to the eutectic alloy powder to produce eutectic alloy powder containing graphite. The graphite added to the eutectic alloy powder was so selected that the sum total of the graphite and the carbon included in the eutectic alloy powder constitutes 4% by weight of the sum total of the graphite and the eutectic alloy powder.

Then, Fe-Cr alloy powder consisting of chromium of 13.5% by weight and iron of the remainder with the particle size not more than 150 meshes was added to the eutectic alloy powder containing graphite so as to constitute 50% by weight of the sum total of the eutectic alloy powder containing graphite and the Fe-Cr alloy powder and to produce mixed alloy powder. Further, zinc stearate of 2% weight was added as a binder to the mixed alloy powder and the mixed alloy powder added the binder thereto was subjected to compression molding at pressure of 5.5 ton/cm$^2$ so as to be formed into a green compact in the shape of chip.

Next, the green compact was subjected to preheating in the ambient atmosphere of hydrogen gas at 600° C. to produce a pre-sintered body. The pre-sintered body was regularly sintered in a vacuum furnace at 1070° C. for 20 minutes and then subjected to heating at about 900° C. for 30 minutes so that a sintered body is obtained.

After that, the sintered body was subjected to quenching in the ambient atmosphere of nitrogen gas and further tempering in a vacuum furnace at 560° C. for 100 minutes, so that the reference sample $T_6$ was obtained.

Figure 4:
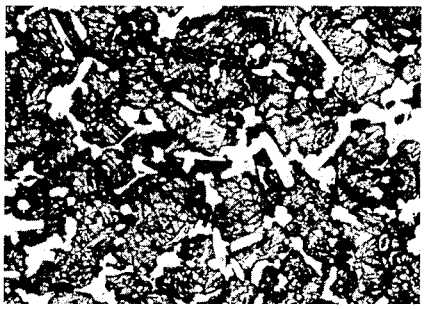

FIG. 4 shows a microphotograph of the internal structure of the reference sample $T_6$. The microphotograph of FIG. 4, indicates that chromium carbides or compound chromium-molybdenum carbides (white portions) are not produced sufficiently in a matrix structure (black portion) compared with the samples $T_1$ and $T_2$ shown in FIGS. 1 and 2, respectively. It was recognized that the reference sample $T_6$ is provided with hardness of $H_{RC}=49$.

Further, the reference sample of ferrous sintered alloys $T_7$ was produced by sintering a green compact which is formed into a chip and includes carbon of 2.1% by weight, chromium of 11.0% by weight, molybdenum of 0.7% by weight, niobium (Nb) of 0.1% by weight and iron of the remainder.

Figure 5:
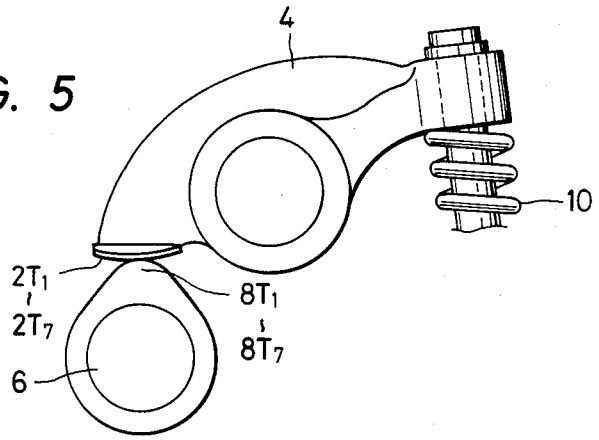
FIG. 5 is a schematic illustration showing a portion of a valve operating mechanism of an engine which is used for a comparison test for comparing in performance ferrous sintered alloys obtained through the embodiment of method according to the present invention with other ferrous sintered alloys obtained through a method other than the method according to the present invention.

For the comparison in performance mentioned above, as shown in FIG. 5, seven rocker arms 4 having respective sliding surfaces $2T_1$, $2T_2$, $2T_3$, $2T_4$, $2T_5$, $2T_6$ and $2T_7$ which were made respectively of four samples $T_1$ to $T_4$ obtained through the method according to the present invention and three reference samples $T_5$ to $T_7$ obtained in accordance with the method other than the method according to the present invention, were created by means of aluminium die-casting. Each of seven rocker arms 4 was so mounted on an engine as to cause the sliding surface $2T_1$, $2T_2$, $2T_3$, $2T_4$, $2T_5$, $2T_6$ or $2T_7$ thereof to come into contact with one of cam lobes $8T_1$, $8T_2$, $8T_3$, $8T_4$, $8T_5$, $8T_6$ and $8T_7$ of a camshaft 6 in the engine, and a spring 10 provided to the rocker arm 4 was adjusted to apply pressure to the cam lobe $8T_1$, $8T_2$, $8T_3$, $8T_4$, $8T_5$, $8T_6$ or $8T_7$ through the rocker arm 4. The engine was operated at 2000 rpm for 200 hours continuously with the same lubricant oil (oil temperature is about 50° C.) to each of seven rocker arms 4. The camshaft 6 was made of alloyed cast iron including carbon of 3.0% by weight, silicone (Si) of 1.5% by weight, molybdenum of 0.6% by weight and chromium 0.08% by weight in addition to iron, and the cam lobes $8T_1$ to $8T_7$ were chilled.

Figure 6:
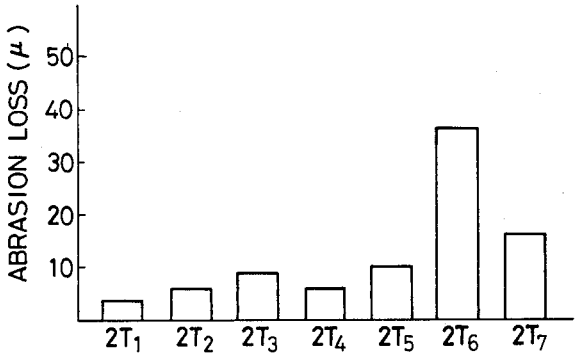
FIGS. 6 and 7 are graphs each showing a result of the comparison test for comparing in performance the ferrous sintered alloys obtained through the embodiment of method according to the present invention with the ferrous sintered alloys obtained through the method other than the method according to the present invention.
Figure 7:
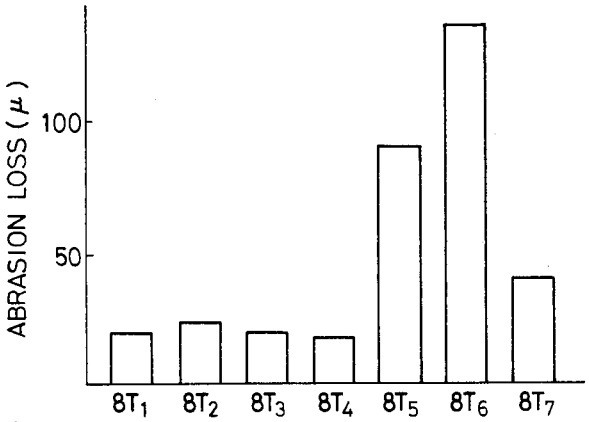

Each of FIGS. 6 and 7 shows a result of the comparison thus carried out.

FIG. 6 shows abrasion loss of each of the sliding surfaces $2T_1$ to $2T_7$ of the rocker arms 4, which were made respectively of four samples $T_1$ to $T_4$ and three reference samples $T_5$ to $T_7$, and FIG. 7 shows abrasion loss of each of the cam lobes $8T_1$ to $8T_7$ of the camshaft 6 with which the sliding surfaces $2T_1$ to $2T_7$ made of four samples $T_1$ to $T_4$ and three reference samples $T_5$ to $T_7$ were in contact respectively during the engine was operated.

As apparent from FIG. 6, although the sliding surfaces $2T_5$, $2T_6$ and $2T_7$ made of the reference samples $T_5$ $T_6$ and $T_7$ had relatively large abrasion loss of 10$\mu$, 36$\mu$ and 16 $\mu$, respectively, each of the sliding surfaces $2T_1$ to $2T_4$ made respectively of the samples $T_1$ to $T_4$ had the abrasion loss less than 10 μ. This results in that each of the samples $T_1$ to $T_4$ had superior abrasion resistance.

Further, as apparent from FIG. 7, although the cam lobes $8T_5$, $8T_6$, and $8T_7$ with which the sliding surfaces $2T_5$, $2T_6$ and $2T_7$ made of the reference samples $T_5$, $T_6$ and $T_7$ come into contact respectively had relatively large abrasion loss of 90 μ, 135 μ and 40 μ, respectively, the cam lobes $8T_1$ to $8T_4$ with which the sliding surfaces $2T_1$ to $2T_4$ made of the samples $T_1$ to $T_4$ come into contact, respectively, had the abrasion loss less than 25 μ. This results in that each of the cam lobes $8T_1$ to $8T_4$ with which the sliding surfaces $2T_1$ to $2T_4$ come into contact respectively was prevented from having undesirably increased abrasion by sliding surfaces $2T_1$ to $2T_4$ made of the samples $T_1$ to $T_4$.

In the embodiment aforementioned, the reason why the Fe-Mo-Cr-P-C eutectic alloy powder is selected to include carbon not more than 4.0 % by weight, chromium within the range of 2.5% to 5.0% by weight, molybdenum within the range of 8.0% to 11.0% by weight, phosphorus within the range of 2.0% to 3.0% by weight, and iron of the remainder is explained as follows.

Carbon combines with chromium molybdenum and iron to produce metallic carbides in the process of sintering and contributes to reinforcing the matrix structure of the ferrous sintered alloy. However, in the event of the melted metal mixture prior to the eutectic alloy powder which obtained in accordance with the atomization method, quantity control for carbon contained therein is hard to carry out appropriately, and it is reasonable that the carbon in the Fe-Mo-Cr-P-C eutectic alloy powder is restricted within the range not more than 4.0% by weight.

Chromiun turns into solid solution in the matrix structure of the ferrous sintered alloy to form hard phases contributing to reinforcement of the matrix structure and further combines with carbon to produce a chromium carbide so as to contribute to improvement in abrasion resistance of the ferrous sintered alloy. As a result of an experiment achieved by the inventors for determining a desirable chromium content in the eutectic alloy powder in consideration of the above mentioned characteristic of chromium, it has been ascertained that the solid solution is not formed sufficiently in the matrix structure of the ferrous sintered alloy when the chromium content is less than 2.5% by weight and a merit reasonably corresponding to an increase in cost can not be obtained when the chromium content is more than 5.0% by weight. Accordingly, the chromium content in the Fe-Mo-Cr-P-C eutectic alloy powder has been determined within the range of 2.5% by weight to 5.0% by weight.

Molybdenum forms hard phases in the matrix structure which contributes to reinforcing the matrix structure in the ferrous sintered alloy and further combines with iron, phosphorus and carbon so as to reduce a melting point of the alloy and thereby to increase liquid phase components in the alloy in the process of sintering. As a result of an experiment achieved by the inventors for determining a desirable molybdenum content in the eutectic alloy powder in consideration of the above mentioned characteristic of molybdenum, it has been ascertained that the melting point of the alloy is not reduced sufficiently in the proces of sintering when the molybdenum content is less than 8.0% by weight, and the liquid phase components are produced excessively in the alloy in the process of sintering so that the ferrous sintered alloy obtained through the process of sintering is reduced in toughness when the molybdenum content is more than 11.0% by weight. Accordingly, the molybdenum content in the Fe-Mo-Cr-P-C eutectic alloy powder has been determined within the range of 8.0% by weight to 11.0% by weight.

Phosphorus combines with iron, molybdenum and carbon to form phosphorous eutectics by which abrasion resistance of the ferrous sintered alloy is improved and further a melting point of the alloy is reduced so as to increase liquid phase components in the alloy in the process of sintering. As a result of an experiment achieved by the inventors for determining a desirable phosphorus content in the eutectic alloy powder in consideration of the above mentioned characteristic of phosphorus, it has been ascertained that the melting point of the alloy is not reduced sufficiently in the process of sintering when the phosphorus content is less than 2.0% by weight, and phosphides are crystallized in the shape of a net around carbides in the matrix structure of the ferrous sintered alloy so that the ferrous sintered alloy is reduced in toughness when the phosphorus content is more than 3.0 % by weight. Accordingly, the phosphorus content in the Fe-Mo-Cr-P-C eutectic alloy powder has been determined within the range of 2.0% by weight to 3.0% by weight.

Then, the reason why the graphite powder is so selected that the sum total of the graphite powder and the carbon included in the Fe-Mo-Cr-P-C eutectic alloy powder constitutes a part within the range of 5% to 8% by weight of the sum total of the graphite powder and the Fe-Mo-Cr-P-C eutectic alloy powder is explained as follows.

Through several experiments made by the inventors, it has been ascertained that liquid phase components are not produced sufficiently in the process of sintering so that the ferrous sintered alloy obtained through the process of sintering is provided therein with a large number of pores undesirably, and also carbides are not obtained sufficiently in the ferrous sintered alloy, and therefore the ferrous sintered alloy is reduced in hardness when the sum total of the graphite powder and the carbon included in the Fe-Mo-Cr-P-C eutectic alloy powder constitutes a part less than 5% by weight of the sum total of the graphite powder and the Fe-Mo-Cr-P-C eutectic alloy powder. Further, it has been also ascertained that carbides or compound carbides which are crystallized in the matrix structure of the ferrous sintered alloy are coarsened so that the ferrous sintered alloy is reduced in toughness when the sum total of the graphite powder and the carbon included in the Fe-Mo-Cr-P-C eutectic alloy powder constitutes a part more than 8% by weight of the sum total of the graphite powder and the Fe-Mo-Cr-P-C eutectic alloy powder. Consequently, the sum total of the graphite powder and the carbon included in the Fe-Mo-Cr-P-C eutectic alloy powder is arranged to constitute the part within the range of 5% to 8% by weight of the sum total of the graphite powder and the Fe-Mo-Cr-P-C eutectic alloy powder.

In addition, since the blowholes formed in the ferrous sintered alloy are increased in size when the graphite powder has an average grain diameter more than 10μ, it is preferable that the graphite powder is selected to have its average particle diameter not more than 10μ.

Furthermore, the reason why the Fe-Cr alloy powder is arranged to include chromium within the range of 11% to 14% by weight and iron of the remainder and to constitute a part within the range of 30% to 70% by weight of the whole mixed alloy powder which consists of the Fe-Mo-Cr-P-C eutectic alloy, the carbon powder and Fe-Cr alloy powder is explained as follows.

Through several experiments made by the inventors, it has been ascertained that solid phase components are not produced sufficiently in the process of sintering the green compact formed with the mixed alloy powder so that liquid phase components are relatively produced excessively in the process of sintering the green compact and therefore it is difficult to keep the ferrous sintered alloy in a predetermined shape properly when the Fe-Cr alloy powder constitutes a part less than 30% by weight of the whole mixed alloy powder. Further, it has been also ascertained that liquid phase components are not produced sufficiently in the process of sintering the green compact when the Fe-Cr alloy powder constitutes a part more than 70% by weight of the whole mixed alloy powder. Accordingly, the Fe-Cr alloy powder content is selected within the range of 30% to 70% by weight of the whole mixer alloy powder.

Incidentally, for providing the ferrous sintered alloy with reduced porosity, it is preferable that each of the Fe-Mo-Cr-P-C eutectic alloy powder and the Fe-Cr alloy powder is selected to have particle size not more than 150 meshes.

Although, in the aforementioned embodiment, the Fe-Mo-Cr-P-C eutectic alloy powder which contains molybdenum and chromium in addition to iron, phosphorus and carbon is used as one example of the eutectic alloy powder, it is preferable that the eutectic alloy powder used in the method according to the present invention is arranged to contain at least one of molybdenum within the range of 8.0% to 11.0% by weight and boron within the range of 0.5 % to 3.0 % by weight, together with chromium within the range of 2.5% to 5.0% by weight, in addition to iron, phosphorus and carbon. In the case where the eutectic alloy powder contains boron, the boron is operative to combine with iron and carbon to form hard phases in the matrix structure of the alloy in the process of sintering and to reduce a melting point of the alloy. In such a case, the hard phases in the matrix structure are not obtained sufficiently when the boron content is less than 0.5% by weight, and liquid phase components are produced excessively in the alloy in the process of sintering so that the ferrous sintered alloy obtained through the process of sintering is reduced in toughness when the boron content is more than 3.0% by weight. Accordingly, is is preferable that the boron content in the eutectic alloy powder is selected to be within the range of 0.5% to 3.0% by weight.

What is claimed is:

1. A method of producing ferrous sintered alloys comprising the steps of;

preparing mixed alloy powder containing Fe-P-C eutectic alloy powder which is obtained by quenching a melted metal mixture to solidify the same and includes phosphorus within the range of 2.0% to 3.0% by weight, carbon not more than 4.0% by weight, and one of molybdenum within the range of 8.0% to 11.0% by weight and boron within the range of 0.5% to 3.0% by weight, graphite so selected that the sum total of the graphite and the carbon included in the Fe-P-C eutectic alloy powder constitutes a part within the range of 5% to 8% by weight of the sum total of the graphite and the Fe-P-C eutectic alloy powder, and ferroalloy powder containing chromium within the range of 11% to 14% by weight and so selected as to constitute a part within the range of 30% to 70% by weight of the whole mixed alloy powder, causing said mixed alloy powder to be subjected to compression molding to have a green compact in a predetermined shape, and sintering said green compact to have a ferrous sintered alloy containing compound carbides in a matrix structure thereof.

2. A method according to claim 1, wherein said Fe-P-C eutectic alloy powder includes chromium within the range of 2.5% to 5.0% by weight.

3. A method according to claim 1, wherein said Fe-P-C eutectic alloy powder is selected to have a particle size not more than 150 mesh.

4. A method according to claim 1, wherein said ferroalloy powder is selected to have a particle size not more than 150 mesh.

5. A method according to claim 1, wherein said graphite is selected to have an average particle diameter not more than 10$\mu$.

6. A method according to claim 1, wherein said step of sintering the green compact includes a process of pre-sintering said green compact in an ambient atmosphere of hydrogen gas.

7. A method according to claim 6, wherein said green compact is pre-sintered in the ambient atmosphere of hydrogen gas at about 600° C. in said process of pre-sintering.

8. A method according to claim 1, wherein said green compact is sintered at temperature within the range of 1060° C. to 1100° C. for 20 to 30 minutes in said step of sintering.

9. A method according to claim 8, wherein said green compact is sintered in a vacuum furnace in said step of sintering.

10. A method according to claim 8, wherein said step of sintering includes a process of heating a sintered body obtained by sintering said green compact at about 900° C. for about 30 minutes.

11. A method according to claim 10, wherein said step of sintering further includes processes of quenching said sintered body in an ambient atmosphere of nitrogen gas and tempering said sintered body having been subjected to quenching at temperature within the range 550° C. to 560° C. for about 100 minutes.

12. A method according to claim 1, wherein Fe-Mo-Cr-P-C eutectic alloy powder including chromium and molybdenum in addition to iron, carbon and phosphorus is used as said Fe-P-C eutectic alloy powder.

* * * * *